United States Patent [19]

Armstrong

[11] 4,153,301

[45] May 8, 1979

[54] APPARATUS FOR BREAKING UP A LAYER OF SUBSTANTIALLY RIGID MATERIAL

[75] Inventor: Anthony C. Armstrong, Abergavenny, Wales

[73] Assignee: Hy-Mac Limited, Rhymney, Wales

[21] Appl. No.: 807,124

[22] Filed: Jun. 16, 1977

Related U.S. Application Data

[63] Continuation of Ser. No. 609,966, Sep. 3, 1975, abandoned.

[30] Foreign Application Priority Data

Sep. 10, 1974 [GB] United Kingdom ..... 39440/74

[51] Int. Cl.[2] ..... E01C 23/12

[52] U.S. Cl. ..... 299/36; 125/23 R; 241/1

[58] Field of Search ..... 299/36, 37, 70; 241/1; 125/23 R, 1; 225/103-105; 144/193 R, 193 A

[56] References Cited

U.S. PATENT DOCUMENTS

| | | | |
|---|---|---|---|
| 2,878,002 | 3/1959 | Haley | 299/36 |
| 3,026,865 | 3/1962 | Sunawa | 125/23 |
| 3,592,509 | 7/1971 | Soderlund | 299/36 |
| 3,980,341 | 9/1976 | Musannit et al. | 299/36 |

FOREIGN PATENT DOCUMENTS

| | | | |
|---|---|---|---|
| 344994 | 3/1931 | United Kingdom | 299/36 |

*Primary Examiner*—William F. Pate, III

*Attorney, Agent, or Firm*—Brisebois & Kruger

[57] ABSTRACT

A concrete or masonry breaker for mounting on a hydraulically operated shovel, for example, in which a pair of jaws pivoted one on the other is operated in pincer fashion by a hydraulic ram, one of the jaws having a long limb along which the ram is disposed to operate the jaws. The long limb provides a long mounting base for the breaker so that high bending moments can more easily be applied to the concrete to break it. A combined forward and backward acting embodiment is described.

14 Claims, 2 Drawing Figures

APPARATUS FOR BREAKING UP A LAYER OF SUBSTANTIALLY RIGID MATERIAL

Figure 1:
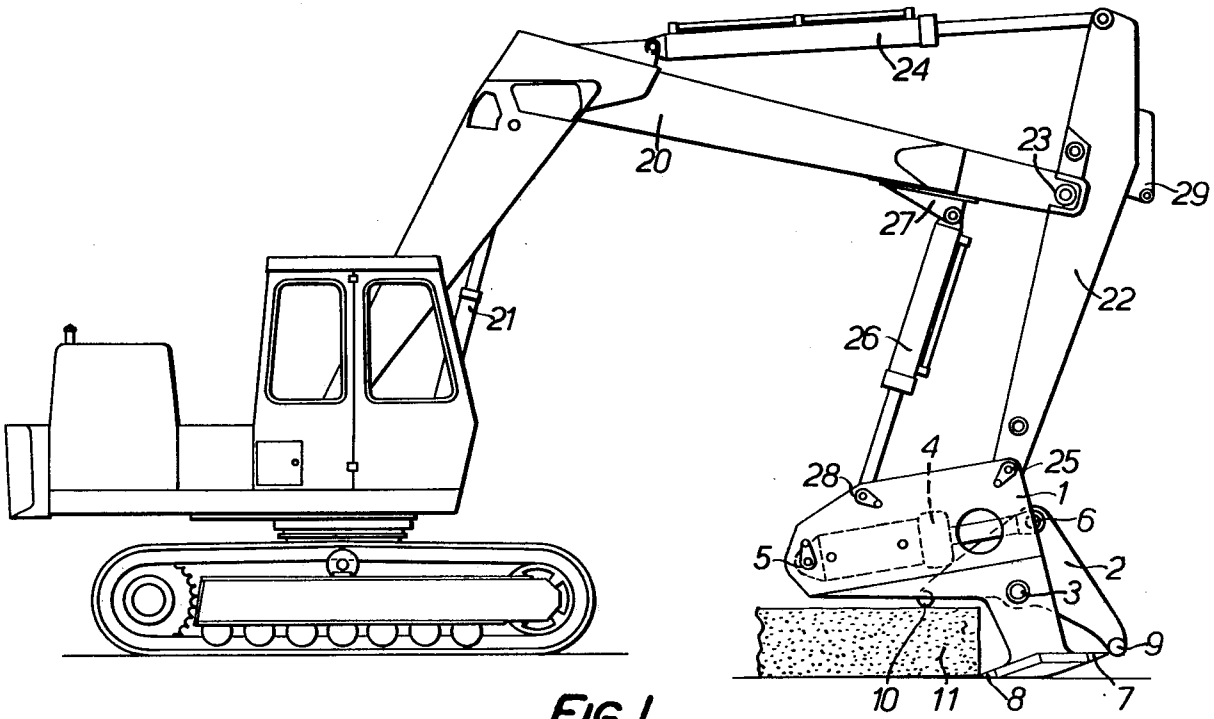

This is a continuation of application Ser No. 609,966, filed Sept. 3, 1975.

This invention relates to apparatus for breaking up a layer of substantially rigid material such as, for example, concrete or masonry.

The most commonly used machines for breaking up a concrete layer are commonly referred to as pneumatic drills, though they may be hydraulic drills or drop hammers, and rely upon percussion to break up the layer. Such machines have two disadvantages which are inherent in their mode of operation, namely they produce a lot of noise due to the percussion and they produce shock waves which travel through the concrete which may disturb structures adjacent to it that may be required to be retained. Drainage pipes in particular are prone to damage in this way.

In order to overcome these problems an alternative apparatus has been proposed which uses a hydraulic ram as an adjustable strut which is extended and locked down on one part of a concrete layer to be broken whilst hooks engage the other side of the layer. The apparatus is then rotated to break off a piece of the layer by subjecting it to a bending moment. This apparatus suffers from the disadvantage that the ram strut being pressed against the concrete layer can slip and must be reset before the breaking of the layer can be effected. In addition, the apparatus requires at least two hydraulic rams to be energised for its operation which if it is to be attached to a conventional excavator means that in most cases at least one additional hydraulic circuit must be provided. Further, the apparatus being only capable of forward actor operation, the excavator must, in moving forward to reach more material to be broken, climb over material already broken. This is inconvenient for clearing broken material and forms an uneven base for the excavator causing it to be unsteady and difficult to operate accurately. Also, the force applied to urge the hooks under the lower side of the layer and the rotating force applied to break off a piece of the layer are derived from the excavator bucket and dipper rams and are limited to their extension and retraction forces respectively. As the apparatus forms an extension of the dipper arm, it suffers from an effective increase in the ratio acting against the dipper ram which is being operated on the annulus or smaller area of the piston.

It is an object of the present invention to provide such apparatus which can be made so as to avoid or reduce any or all of the disadvantages just described.

According to the present invention there is provided apparatus for breaking up a layer of a substantially rigid material, such as, for example, concrete or masonry, the apparatus having apparatus for breaking up a layer of a substantially rigid material, for example, concrete or masonry, the apparatus having first and second rigid jaw members, the first jaw member having a single projecting tooth with an axis extending from the root of the tooth to the tip of the tooth, the second jaw member having a pressure surface opposed to the tooth, the second jaw member being movably mounted on the first jaw member to form a combination including a substantially U-shaped structure having an opening for receiving a layer to be broken between the tooth and the pressure surface, the axis of the tooth forming one limb of the U-shaped structure, and the movable mounting being such as to cause the pressure surface to move along a path intersecting the tip of the tooth, whereby the tooth and the pressure surface of the second jaw member can be closed on to a layer as a result of the movement of the second jaw member relative to the first jaw member, and hydraulic ram means mounted on the first jaw member coupled to the second jaw member to move the pressure surface along said path, the first member having mounting means enabling a torque about an axis perpendicular to the plane of the U-shaped structure to be applied to the apparatus.

The first jaw member may be provided with a limb to which the mounting means is attached, the limb being long relative to the opening defined by the tooth and the second jaw member, and the hydraulic ram means being mounted to lie along the limb. The second jaw member may be longer than the tooth on the first member so that a breaking torque can more easily be applied to the layer to break it.

By providing the first jaw member with a relatively long limb, the hydraulic ram can be given a long stroke which will enable the opening between the jaw members to be openable sufficiently to accommodate the greatest thickness of layer which it is proposed the apparatus should be able to break. The long limb also provides a good base for coupling the apparatus to a dipper of a hydraulically operated shovel or excavator or other plant machine so that the bending moment applied by the apparatus to the layer to be broken is not transmitted disadvantageously through the boom in such a way as to tend to upset the machine. Conveniently the apparatus may be attached to the machine in place of its bucket using the bucket ram mounted in its normal bucket operation position on the dipper. Alternatively, the bucket ram may be removed from the dipper and relocated on a bracket specially provided on the boom to form a parallelogram linkage in conjunction with the dipper and the apparatus. The apparatus may be designed to exert the necessary force on a layer to break it purely by the action of the single ram which it contains. Alternatively, the force may be applied by that ram in combination with the bucket ram, for example, of the shovel or excavator. The first rigid jaw member may be provided with both forward-facing and backward-facing teeth for enabling the apparatus to work in a forward or backward direction. In this case the second jaw member would be formed to operate in conjunction with either of the teeth of the first member depending upon the direction of actuation of the single hydraulic ram.

It is intended that the apparatus should be attached to a mechanically operated shovel or excavator or other item of plant and by virtue of having only a single ram for operating the second jaw member, no additional hydraulic controls are required over and above those normally provided for such a machine.

The jaw members may be arranged so as to be able to pick up objects from, for example, a demolition area, the jaws being able to close substantially completely to enable relatively thin objects such as, for example, steel girders to be picked up.

Preferably, the apparatus is mounted on a shovel or excavator or other plant machine by means of a parallelogram linkage. An advantage of such a mounting is that the attitude of the apparatus remains substantially unchanged as the dipper is swung forward or backwards to cause the apparatus to engage a layer of concrete; this saves the operator having to make additional adjustments. A further significant advantage is that the apparatus no longer presents an effective increase to the length of the dipper but rather in moving substantially parallel to the layer to be broken, reproduces substantially the same movement and hence substantially the same force at the first rigid lower jaw as that at the attachment pivot pin between the dipper and the apparatus. The lever ratio acting against the dipper ram is thus considerably reduced resulting in a higher thrust being available to force the first rigid jaw member under the layer to be broken.

Figure 2:
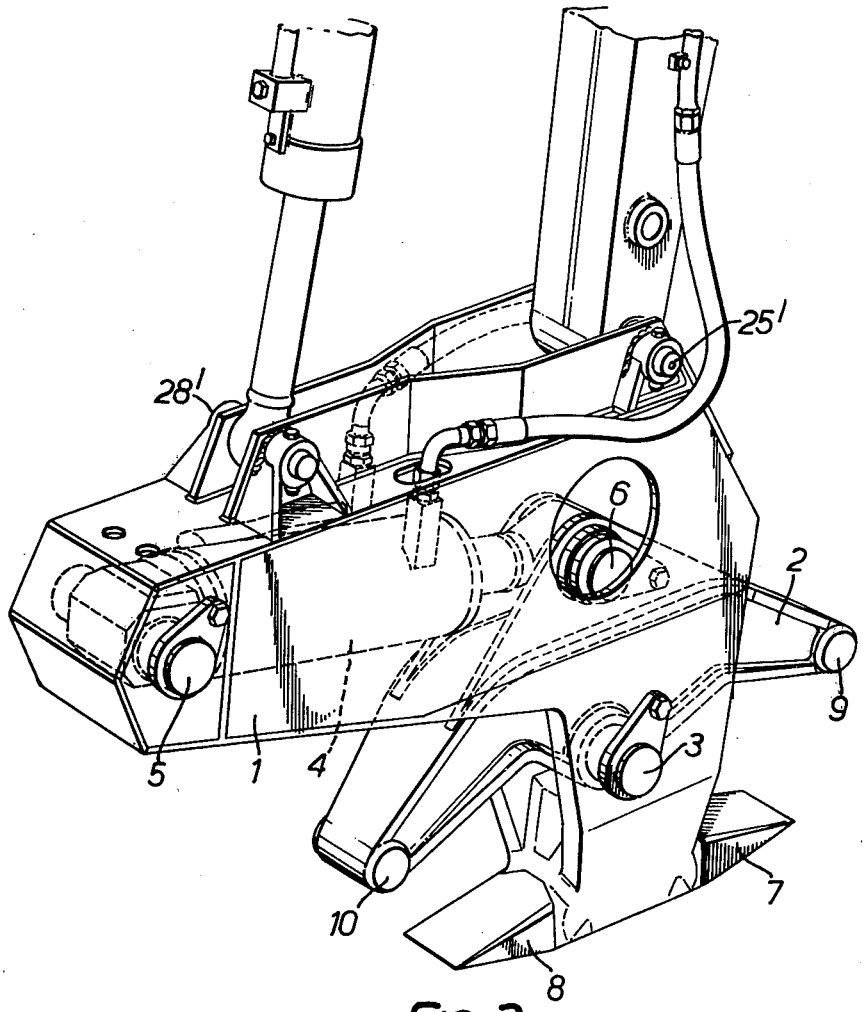

In order that the invention may be fully understood and readily carried into effect, it will now be described with reference to the accompanying drawings, of which:

FIG. 1 is a diagrammatic side-view of one example of apparatus according to the invention attached to a hydraulically operated shovel or excavator, and FIG. 2 is a perspective sketch of the example for the invention shown in FIG. 1.

Referring to the drawings, the example of the invention shown includes a first jaw member 1 on which is pivoted a second jaw member 2 at pivot 3. The jaw member 2 is rotated about the pivot 3 by means of an hydraulic ram 4 which is mounted on the first member 1 at a pivot 5 and drives the second member 2 by means of a pin 6. The first member 1 has a forwardly projecting tooth 7 and backwardly projecting tooth 8. The second jaw member 2 has at its forward extremity a bar 9 which can be brought nearly into contact with the tooth 7 by clockwise rotation of the jaw member 2. The member 2 has at its rearmost extension a second bar 10 which can be brought nearly into contact with the tooth 8 by anti-clockwise rotation of the member 2, but as shown in FIG. 1 is in contact with the upper surface of a layer 11 of concrete to be broken. The length of the jaw member 2 from its pivot 3 to each bar 9 and 10 is greater than that of each of the teeth 7 and 8 so that a torque can more easily be applied to the layer 11 to break it. The tooth 8 is shown engaging the lower forward corner of the layer 11 and is being urged under the layer by extension of dipper ram 24. The layer 11 is further being prised up by the retraction of repositioned bucket ram 26 until the top of the first jaw member 1 is approximately parallel to the layer with the result that if the ram 4 were to be retracted the bar 10 would press down on to the upper surface of the layer 11, thus causing an additional local bending moment to be exerted on the end section of the layer breaking it off.

The shovel or excavator shown in FIG. 1 has an angled boom 20 which can be raised or lowered by a ram 21 and a dipper 22 pivoted on the end of the boom 20 at the pivot 23 and being rotated about that pivot by a dipper ram 24. The first jaw member 1 is pivotally mounted on the end of the dipper 22 at the pivot 25 and a bucket ram 26 extends from a lug 27 attached to the boom 20 to a rearward pivot 28 on the member 1. The particular shovel or excavator shown would normally have a bucket mounted on the pivot 25 and the attitude of the bucket would be controlled by the bucket ram 26 which in that case would be pivoted on the lug 29. A push link and lever (not shown) are normally interposed between the bucket ram 26 and the bucket to increase the total angle of rotation of the bucket about pivot 25. The lever would normally be pivoted at the position shown just above pivot 25. A push link and lever are not required for normal operation of the apparatus and so are not shown. However, for special applications such as the demolition of floors and walls considerably above or below ground level but still within the reach of the shovel or excavator, a suitable push link and lever may be interposed to allow the apparatus to be correctly presented to the layer to be broken. The shovel or excavator, of which the Hy-Mac 590 shown is a typical example, includes in its standard complement an auxiliary control valve more normally provided for the rotation of a grab if this were to be fitted in place of the bucket. The bucket ram control would be used to operate the grab. It is proposed to use the auxiliary hydraulic circuit for operating ram 4 of the apparatus. It is, however, quite practical to interchange the controls such that the bucket control operates ram 4 and the auxiliary control operates bucket ram 26.

FIG. 2 is a perspective sketch of the apparatus shown in FIG. 1, and corresponding components have the same references as in that Figure. From FIG. 2, it will be seen that the jaw members 1 and 2 each consist of two plates side by side with the member 2 lying between the two plates formed by the member 1. The lower part of the member 1 is formed by two plates which are inclined inwardly so as almost to meet, and hardened steel teeth 7 and 8 project respectively forwardly and backwardly from the lower ends of the inclined portions. References 25' and 28' represent the mountings for the pivots 25 and 28 of FIG. 1.

In the example of the invention under consideration, the height of the member 1 in its upright position is 46½ inches, the radii of the bars 9 and 10 relative to the pivot 3 are respectively 26 inches and 22 inches, the difference being provided to allow for the lower effectiveness of the ram 4 in retraction compared with extension. The thicknesses of the plates of which the apparatus is formed varies between ¾ of an inch and 2 inches, depending on the forces required to be withstood by the particular part. The width of the teeth 7 and 8 is 6 inches and they are each 10 inches long, and the bars 9 and 10 are 4 inches in diameter and 8 inches long. It is envisaged that this example of the invention would be capable of breaking reinforced concrete up to a thickness of 15 inches.

The upper part of the jaw member 1 is some 5 feet long, which is large compared with the 15 inches opening provided between the jaw members 1 and 2, and this length provides room for an hydraulic ram 4 having a relatively long stroke so that a single ram is all that is needed to operate the jaw member 2 with sufficient force to break reinforced concrete up to 15 inches thickness, at the same time providing an opening sufficiently wide to accommodate such a layer. The length of the member 1 also means that the base over which the forces to be applied to the concrete react on the shovel or excavator is long and therefore the forces on the shovel or excavator are relatively smaller. In fact, the construction shown in FIG. 1 means that the bending moment applied to the layer 11 is attempting to lift the motor unit of the excavator over an arm of some 15 feet in length. It will be appreciated that the moment necessary to upset the shovel or excavator motor unit would need to be in excess of 250 foot tons, which would be well in excess of the forces necessary to break the concrete.

The apparatus need not necessarily be mounted on a shovel or excavator as shown, but it could be on, for example, a fork-lift truck instead of some other kind of plant machine having hydraulic actuation of a component part. Moreover, the geometrical configuration of the apparatus need not be as shown in the example described but may, for example, have a first jaw member which extends more or less vertically, with the hydraulic ram for rotating the second jaw member being disposed similarly. With such an arrangement the apparatus would be attached to the dipper 22 at the pivot 25 shown in FIG. 1 with the ram 26 disposed to maintain the attitude of the first jaw member, which would define with the second jaw member only one opening. To obtain both forward and backward action, the whole apparatus could be rotated about a vertical axis using the bucket ram 26 as a swivel. Two pivot positions 25 on the forward and backward faces of the first jaw member would be needed for it to be attached to the dipper arm 22 in the two positions. Such a construction is lighter and cheaper and so more suited to the smaller wheeled type of excavator/loader but does not have the advantage of parallelogram action. It would thus be limited to layer thicknesses considerably less than 15 inches, the probable maximum being 9 inches to 10 inches. Whilst it is of advantage for the apparatus to be able to be operated in a forward and in a reverse direction, it is not necessary for it to be so constructed. The apparatus may be attached to the dipper 22 with the second jaw member nearer the operator so that his view of the jaw members is not obscured by the hydraulic ram 4.

Although as described above the breaking of the layer 11 is effected purely by the operation of the ram 4, it would be possible for the ram 4 to be used merely to position the jaw member 2 to grip the layer 11 and then for the ram 26 to be operated to apply the bending moment to the layer 11. This alternative mode of operation could equally well be used in the forward direction. However, the bending moment derived from ram 4 reacting against ram 26 can be greater than the bending moment derived from ram 26 reacting against ram 4. The size of ram 26 is dictated by the machine used to mount the apparatus whereas the size of ram 4 is at the discretion of the designer of the apparatus; within the limit set by the ability of ram 26 to resist an induced load. Generally all hydraulic rams can withstand an approximately 25% greater induced loading than they themselves can exert. Thus the limit of breaking torque available from ram 26 can be exceeded by ram 4 so increasing the capability of the apparatus over that of designs relying on the equivalent of ram 26 to produce the breaking torque. The addition of the parallelogram action in increasing the force available to urge the teeth under the layer broken similarly increases the capability of the apparatus.

Another advantage of the particular construction shown in FIG. 1 is that the ram 24 can be used very effectively to force the teeth 7 and 8 under a layer to be broken. The action of urging teeth 7 or 8 under the layer 11, gives a prising up action which effectively produces a bending force in the layer 11. The bending force is in addition to that produced by rams 4 and 26 and so additionally increases the total capability of the apparatus.

Although as described the invention has been used for breaking up horizontally disposed layer, it will be apparent that it could be used for breaking layers disposed at any angle such as, for example, walls, ramps, and so on. Moreover, the mounting points on the apparatus may be located differently from those shown or several alternative mountings may be provided. Furthermore, the hydraulic ram in the apparatus may be arranged at a different angle relative to the jaw members.

I claim:

1. Apparatus for breaking up a layer of a substantially rigid material, for example, concrete or masonry, the apparatus having a pincer mechanism including first and second rigid jaw members, the first jaw member having a single projecting tooth with an axis extending from the root of the tooth to the tip of the tooth, the second jaw member having a pressure surface directly opposed to the tooth, the second jaw member being movably mounted on the first jaw member to form a combination including a substantially U-shaped structure having an opening for receiving a layer to be broken between the tooth and the pressure surface, the axis of the tooth forming one limb of the U-shaped structure, and the movable mounting being such as to cause at least one point of the pressure surface to move along a path which is such that the point would pass through the tip of the tooth if the second jaw member were to be moved a sufficient amount, whereby the tooth and the pressure surface of the second jaw member can be closed on to a layer as a result of the movement of the second jaw member relative to the first jaw member, and hydraulic ram means mounted on the first jaw member coupled to the second jaw member to move the pressure surface along said path a sufficient distance to close it on to a layer to be broken, the first jaw member having mounting means enabling a torque about an axis perpendicular to the plane of the U-shaped structure to be applied to the apparatus.

2. Apparatus according to claim 1 wherein the second jaw member is longer than the tooth on the first jaw member and the pressure surface of the second jaw member is formed by a bar at an extremity of the second jaw member which can be brought into close proximity with the tip of the tooth.

3. Apparatus according to claim 1 wherein the first jaw member has a limb to which the mounting means is attached, the limb being long relative to the opening defined by the jaw members, and the hydraulic ram being mounted to lie along the limb.

4. Apparatus according to claim 14 in which the second jaw member is pivoted on the first jaw member and the hydraulic ram means is coupled to rotate the second jaw member about the pivot so that the at least one point of the pressure surface follows an arc of a circle which passes through the tip of the tooth.

5. Apparatus according to claim 1 wherein the mounting means comprises two pivots spaces apart on the first jaw member.

6. Apparatus for breaking up a layer of a substantially rigid material, such as for example concrete or masonry, the apparatus having first and second rigid jaw members, the first jaw member having two teeth which project in opposite directions and are respectively opposed to two pressure surfaces of the second jaw member, the teeth and the pressure surfaces of the second jaw member defining two openings facing in opposite directions for receiving a layer to be broken, the second jaw member being pivoted on the first jaw member to cause the pressure surfaces to describe paths which intersect the tips of the respective teeth, so that one or other opening can be closed on to a layer, and hydraulic rams means mounted on the first jaw members coupled to pivot the second jaw member to close one or other opening, the first jaw member having mounting means such as to enable a torque about an axis parallel to the pivot axis of the second jaw member to be transmitted to the apparatus.

7. Apparatus according to claim 6 wherein the second jaw member is of approximately triangular shape having a first pivot located near the middle of one side and a second pivot located near the vertex opposite the one side, the second jaw member being pivoted on the first jaw member at the first pivot and the hydraulic ram means being arranged to act on the second pivot, the two other vertices of the second jaw member being arranged to perform pinching movement respectively towards the two teeth on the first jaw member as the second jaw member is rotated on the first pivot in respective directions.

8. Apparatus according to claim 6 wherein the first jaw member includes two side plates between which are disposed the second jaw member and a single hydraulic ram.

9. Apparatus for breaking up a layer of a substantially rigid material, for example, concrete or masonry, the apparatus having a pincer mechanism including first and second rigid jaw members, the first jaw member having a single projecting tooth with an axis extending from the root of the tooth to the tip of the tooth, the second jaw member having a pressure surface directly opposed to the tooth, the second jaw member being movably mounted on the first jaw member to form a combination including a substantially U-shaped structure having an opening for receiving a layer to be broken between the tooth and the pressure surface, the axis of the tooth forming one limb of the U-shaped structure, and the movable mounting being such as to cause at least one point of the pressure surface to move along a path which is such that the point would pass through the tip of the tooth if the second jaw member were to be moved a sufficient amount, whereby the tooth and the pressure surface of the second jaw member can be closed on to a layer as a result of the movement of the second jaw member relative to the first jaw member, and hydraulic ram means mounted on the first jaw member coupled to the second jaw member to move the pressure surface along said path a sufficient distance to close it on to a layer to be broken, the first jaw member having mounting means enabling a torque about an axis perpendicular to the plane of the U-shaped structure to be applied to the apparatus, wherein the first jaw member is substantially L-shaped, one limb of which being the limb to which the mounting means is attached and along which the hydraulic ram means lies and the one limb being long relative to the opening defined by the jaw members, and the other limb of which being provided with said one tooth which projects therefrom substantially parallel to the one limb.

10. A hydraulically operated machine including a chassis member, a boom pivoted on the chassis member, a dipper pivoted on the boom, first hydraulic ram means capable of rotating the boom relative to the chassis member, second hydraulic ram means capable of rotating the dipper relative to the boom, and apparatus for breaking up a layer of a substantially rigid material, such as for example concrete or masonry, the apparatus having first and second rigid jaw members, the first jaw member having two teeth which project in opposite directions and are respectively opposed to two pressure surfaces of the second jaw member, the teeth and the pressure surfaces of the second jaw member defining two openings facing in opposite directions for receiving a layer to be broken, the second jaw member being pivoted on the first jaw member to cause the pressure surfaces to describe paths which intersect the tips of the respective teeth, so that one or other opening can be closed on to a layer, and hydraulic ram means mounted on the first jaw members coupled to pivot the second jaw member to close one or other opening, the first jaw member having mounting means such as to enable a torque about an axis parallel to the pivot axis of the second jaw member to be transmitted to the apparatus, wherein the first jaw member is mounted on the dipper, so that movement of the dipper enables the jaw members to be brought into engagement with a layer of concrete or masonry.

11. A hydraulically operated machine including a chassis member, a boom pivoted on the chassis member, a dipper pivoted on the boom, first hydraulic ram means capable of rotating the boom relative to the chassis member, second hydraulic ram means capable of rotating the dipper relative to the boom, and apparatus for breaking up a layer of a substantially rigid material, for example, concrete or masonry, the apparatus having a pincer mechanism including first and second rigid jaw members, the first jaw member having a single projecting tooth with an exis extending from the root of the tooth to the tip of the tooth, the second jaw member having a pressure surface directly opposed to the tooth, the second jaw member being movably mounted on the first jaw member to form a combination including a substantially U-shaped structure having an opening for receiving a layer to be broken between the tooth and the pressure surface, the axis of the tooth forming one limb of the U-shaped structure, and the movable mounting being such as to cause at least one point of the pressure surface to move along a path which is such that the point would pass through the tip of the tooth if the second jaw member were to be moved a sufficient amount, whereby the tooth and the pressure surface of the second jaw member can be closed on to a layer as a result of the movement of the second jaw member relative to the first jaw member, and hydraulic ram means mounted on the first jaw member coupled to the second jaw member to move the pressure surface along said path a sufficient distance to close it on to a layer to be broken, the first jaw member having mounting means enabling a torque about an axis perpendicular to the plane of the U-shaped structure to be applied to the apparatus, wherein the first jaw member is mounted on the dipper, so that movement of the dipper enables the jaw members to be brought into engagement with a layer of concrete or masonry.

12. A machine according to claim 11 in which the apparatus is pivoted on the dipper and there is provided a third hydraulic ram means coupled to the apparatus to enable its attitude to be changed relative to the dipper, whereby the apparatus can perform a translational movement substantially without rotation to engage a layer of concrete or masonry.

13. A machine according to claim 12 wherein the third hydraulic ram means extends from a pivot on the boom to the apparatus so as to form substantially a prallelogram linkage with the dipper for mounting the apparatus.

14. A machine according to claim 12 consisting of a hydraulically operated shovel or excavator with the apparatus substituted for the bucket.

* * * * *